United States Patent [19]

Bergthaller et al.

[11] Patent Number: 4,939,075

[45] Date of Patent: Jul. 3, 1990

[54] BLEACHING BATHS CONTAINING BLEACHING ACCELERATORS

[75] Inventors: Peter Bergthaller, Bergisch Gladbach; Helmut Häseler, Leverkusen; Heinz Meckl, Bergisch Gladbach, all of Fed. Rep. of Germany

[73] Assignee: Agfa-Gevaert Aktiengesellschaft, Leverkusen, Fed. Rep. of Germany

[21] Appl. No.: 282,121

[22] Filed: Dec. 9, 1988

[30] Foreign Application Priority Data

Dec. 23, 1987 [DE] Fed. Rep. of Germany ..... 3743783

[51] Int. Cl.[5] ..... G03C 5/38; G03C 5/44

[52] U.S. Cl. ..... 430/460; 430/430; 430/461

[58] Field of Search ..... 430/430, 460, 461; 252/186.1, 186.21, 186.33

[56] References Cited

U.S. PATENT DOCUMENTS 4,756,918 7/1988 Ueda et al. ..... 430/430

*Primary Examiner*—Richard L. Schilling

[57] ABSTRACT

In the case of color materials with the usual processing times, bleaching and bleaching/fixing baths containing an iron(III) ion complex salt as bleach and, in addition, a 5- to 7-membered heterocyclic compound containing at least one N-atom and at least one other hetero atom from the group consisting of O,S,N which is substituted by —S$^{\ominus}$ and, at a quaternary ring nitrogen atom, carries a positive charge arranged in such a way that no tautomeric charge compensation to a neutral thione form is possible, provide for good bleaching, i.e. for black areas free from residual silver in the case of color negative materials and for low minimum densities in the case of color reversal materials, by virtue of their excellent bleaching rate and, at the same time, their high stability.

9 Claims, No Drawings

BLEACHING BATHS CONTAINING BLEACHING ACCELERATORS

This invention relates to bleaching baths for processing an exposed color photographic, photosensitive silver halide material, in which the bleaching function is accelerated so that the processing time is shortened and even difficult-to-bleach image silver can be completely bleached. In reversal materials, the minimum densities are reduced.

The basic steps involved in the processing of photosensitive color materials generally comprise a color development step and a silver removal step. In the case of reversal materials, there is a preliminary black-and-white development step and a second exposure. In the last step, the silver produced during development is oxidized with a bleaching agent and dissolved with a fixing agent.

The silver may be removed in two steps using a bleaching bath and a fixing bath or in one step using a combined bleaching and fixing bath.

Bleaching is mainly carried out using an iron(III) ion complex salt (for example aminopolycarboxylic acid-iron(III) complex salt, more especially iron(III)-ethylenediaminetetraacetate complex salt). Iodoso compounds, persulfates, cobalt(III) ion complex salts and cerium(IV) ion complex salts are also suitable.

However, iron(III) ion complex salts show comparatively low oxidative power. Accordingly, there was a need to increase the bleaching power of a bleaching solution or bleaching/fixing solution containing a bleaching agent of low bleaching power, more especially an iron(III) ion complex salt.

In order to increase the bleaching power of a bleaching solution or bleaching/fixing solution containing an iron(III) ion complex salt, such as iron(III)-ethylenediaminetetraacetate as bleaching agent, it has been proposed to add various bleaching accelerators to the processing bath.

Examples of bleaching accelerators include thiourea derivatives, (JP-OS 8506/70, U.S. Pat. No. 3,706,561), seleno-urea derivatives (JP-OS 280/71), mercapto compounds with a 5-membered ring (GB-P 1,138,842), thiazole derivatives and thiadiazole derivatives (CH-P 336,257). In addition, 5-mercaptotetrazoles have been used as accelerators for the removal of silver in a bleaching and fixing solution (GB-P 1,138,842). However, these compounds show only a weak accelerating power, poor solubility or inadequate stability in the processing solution.

DE-OS 35 18 257 describes the bleaching-accelerating effect of compounds corresponding to the following formulae

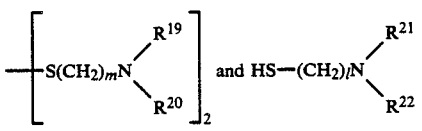

in which $R^{19}$ to $R^{20}$ represent hydrogen, alkyl, acyl or, together, represent the remaining members of a ring and m and l are integers of 1 to 3.

These compounds also show only a moderate bleaching-accelerating effect and are unsuitable for color reversal materials and particularly for color reversal paper.

In the processing of color reversal paper, bleaching-/fixing baths based on iron(III)-EDTA are normally used for the removal of silver from the paper after the first development, the second exposure and color development. In contrast to the processing of color negative paper, it is necessary in the processing of color reversal paper to add bleaching accelerators to the bleaching-/fixing bath to ensure that bleaching takes place sufficiently quickly and completely. Such compounds as 3-mercapto-1,2,4-triazole or 5-amino-2-mercapto-1,3,4-thiadiazole are successfully used for this purpose.

However, the use of bleaching accelerators in the bleaching/fixing bath has also proved to be advisable in the processing of color negative paper. In the event of inadequate bleaching, residues of silver remain in the materials which, in the generally IR-controlled cutting machines, can lead to incorrect information as a result of which the film strip is cut through the frames rather than between the frames.

If two separate baths, namely a bleaching bath and a fixing bath, are used instead of a combined bleaching and fixing bath, which can be of advantage by virtue of the easier recovery of the dissolved silver, it is not possible to use these bleaching accelerators because they no longer have an adequate accelerating effect in the bleaching bath and because, in some cases, they are not sufficiently soluble or produce sediments. In the absence of bleaching accelerators, the inadequately bleached photographic papers show considerable residual silver contents in the dark parts of the image which cannot be significantly reduced, even by longer bath residence times.

In the processing of color reversal paper, the number of tanks for chemicals and water tanks is usually limited. Where bleaching and fixing are carried out separately, the number of tanks required is in any case increased by two, while an additional conditioning bath of the type normally used for color reversal film, because the conditioning agent, thioglycerol, normally used decomposes very quickly in the bleaching bath, would increase it by three tanks. In many cases, this is not possible without expensive reconstruction of the machines. In order to minimize the number of tanks, therefore, it is best to avoid an additional conditioning bath.

Accordingly, there is an interest in additives for bleaching baths which have such a high bleaching-accelerating effect that pure white areas are formed on the color reversal papers in the normal bleaching times (1 to 5 minutes) and which, in addition, show adequate stability in the usual iron(III)-EDTA bleaching baths.

The object of the present invention is to provide bleaching or bleaching-and-fixing baths, preferably bleaching baths, which are stable, show an excellent bleaching rate and form no sediment. In the case of reversal materials, they are intended to provide for low minimum densities in the usual processing times and, in the case of color negative papers, for complete bleaching of the residual silver in the black areas without, in either case, adversely affecting other photographic properties.

According to the invention, this object is achieved by addition to bleaching or bleaching/fixing baths containing an iron(III) ion complex salt as bleaching agent a 5-membered to 7-membered heterocyclic compound which contains at least one N atom and at least one other heteroatom from the group consisting of O, N, S and which is substituted by —S⊖ and, at a quaternary ring nitrogen atom, carries a positive charge arranged in such a way that a tautomeric charge equalization to a neutral thione form is not possible.

Particularly preferred compounds correspond to the following formula

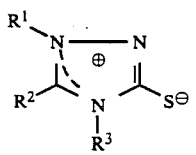

(I)

in which $R^1$ represents $C_1$–$C_8$ alkyl, heteroaryl, $C_5$–$C_{10}$ cycloalkyl and $C_6$–$C_{12}$ aryl, optionally containing a hydrophilicizing group, $R^2$ represents hydrogen, $C_1$–$C_8$ alkyl, $C_2$–$C_8$ alkenyl, heteroaryl, $C_5$–$C_{10}$ cycloalkyl and $C_6$–$C_{12}$ aryl, $C_1$–$C_8$ dialkylamino, optionally containing a hydrophilicizing group, $R^3$ represents amino, acylamino, $C_1$–$C_8$ dialkylamino, sulfonamido, sulfamoyl amino, $C_1$–$C_8$ alkyl, $C_2$–$C_8$ alkenyl, $C_1$–$C_3$ alkoxy-$C_1$–$C_5$ alkyl, $C_5$–$C_{10}$ cycloalkyl and $C_6$–$C_{12}$ aryl, optionally containing a hydrophilicizing group;

$R^1$ and $R^2$ or $R^2$ and $R^3$ together may represent the groups required to complete a heterocyclic ring.

Other preferred compounds correspond to formulae II and below

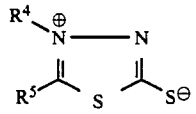

II

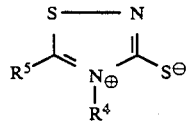

III in which $R^4$ represents $C_1$–$C_8$ alkyl, heteroaryl, $C_5$–$C_{10}$ cycloalkyl and $C_6$–$C_{12}$ aryl, optionally containing a hydrophilicizing $R^5$ represents hydrogen, di-$C_1$–$C_8$ alkylamino, $C_1$–$C_8$ alkyl, $C_2$–$C_8$ alkenyl, heteroaryl, $C_5$–$C_{10}$ cycloalkyl and $C_6$–$C_{12}$ aryl, optionally containing a hydrophilicizing group;

$R^4$ and $R^5$ together may represent the groups required to complete a heterocyclic ring;

and to formula IV

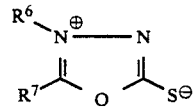

IV in which $R^6$ represents $C_1$–$C_8$ alkyl, heteroaryl, $C_5$–$C_{10}$ cycloalkyl and $C_6$–$C_{12}$ aryl, optionally containing a hydrophilicizing group, $R^7$ represents hydrogen, di-$C_1$–$C_8$ alkylamino, $C_1$–$C_8$ alkyl, $C_2$–$C_8$ alkenyl, heteroaryl, $C_5$–$C_{10}$ cycloalkyl and $C_6$–$C_{12}$ aryl, optionally containing a hydrophilicizing group;

$R^6$ and $R^7$ together may represent the groups required to complete a heterocyclic ring;

to formula V

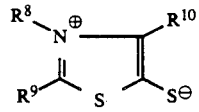

V in which $R^8$ represents $C_1$–$C_8$ alkyl, heteroaryl, $C_5$–$C_{10}$ cycloalkyl and $C_6$–$C_{12}$ aryl, optionally containing a hydrophilicizing group, $R^9$ and $R^{10}$ represent hydrogen, $C_1$–$C_8$ alkyl, $C_2$–$C_8$ alkenyl, heteroaryl, $C_5$–$C_{10}$ cycloalkyl and $C_6$–$C_{12}$ aryl, optionally containing a hydrophilicizing group;

$R^8$ and $R^9$ or $R^8$ and $R^{10}$ together may represent the groups required to complete a heterocyclic ring, to formula VI

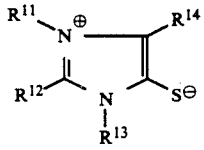

VI in which $R^{11}$ and $R^{13}$ represent $C_1$–$C_8$ alkyl, heteroaryl, $C_5$–$C_{10}$ cycloalkyl and $C_6$–$C_{12}$ aryl, optionally containing a hydrophilicizing group, $R^{12}$ and $R^{14}$ represent hydrogen, $C_1$–$C_8$ alkyl, $C_2$–$C_8$ alkenyl, heteroaryl, $C_5$–$C_{10}$ cycloalkyl and $C_6$–$C_{12}$ aryl, optionally containing a hydrophilicizing group, $R^{11}$ and $R^{14}$ or $R^{11}$ and $R^{12}$ or $R^{12}$ and $R^{13}$ together may represent the groups required to complete a heterocyclic ring, and to the following formula

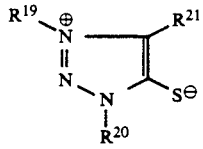

VII in which $R^{19}$ and $R^{20}$ represents $C_1$–$C_3$ alkyl, $R^{21}$ represents hydrogen and methyl.

Sulfonamido represents compounds corresponding to the general formula $R^{15}$—$SO_2$—NH—, in which $R^{15}$ is hydrogen, $C_1$–$C_8$ alkyl, $C_5$–$C_7$ cycloalkyl, $C_6$–$C_{12}$ aryl or heteroaryl.

Sulfamoylamino represents compounds corresponding to the general formula $R^{16}R^{17}N$—$SO_2$—NH—, where $R^{16}$ and $R^{17}$ may be the same or different and represent hydrogen, $C_1$–$C_8$ alkyl, $C_5$–$C_6$ cycloalkyl, $C_6$–$C_{12}$ aryl or heteroaryl.

Acylamino represents compounds corresponding to the general formula $R^{18}$—CO—NH—, where $R^{18}$ is hydrogen, $C_1$–$C_8$ alkyl, $C_5$–$C_7$ cycloalkyl, $C_6$–$C_{12}$ aryl or heteroaryl.

Heteroaryl generally represents a 5-membered or 6-membered, optionally benzo-condensed heteroaromatic ring containing 1 to 3 heteroatoms from the group consisting of N, O and S.

Hydrophilicizing groups are understood to be the following structures: COOH, $SO_3H$, $PO(OH)_2$, $CH_2OH$, $—(O—CH_2—CH_2)_{2-20}—OH$.

Suitable compounds are shown in the following:

B 1

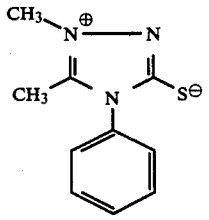

B 2

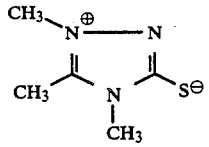

B 3

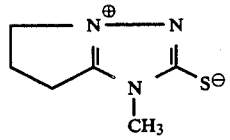

B 4

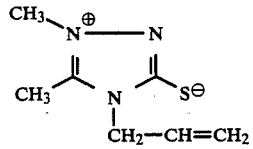

B 5

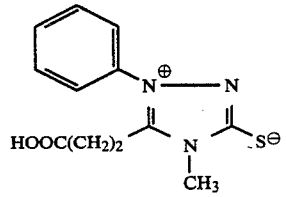

B 6

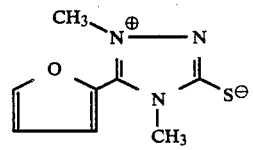

B 7

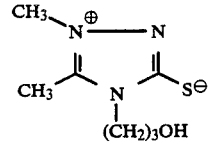

B 8

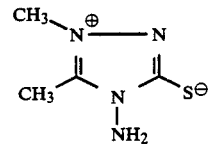

-continued

B 9

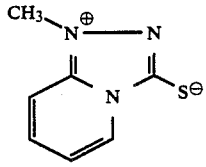

B 10

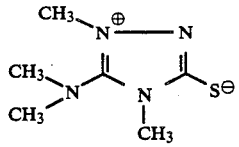

B 11

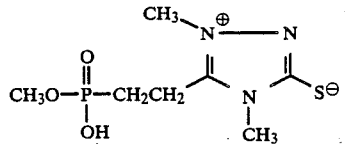

B 12

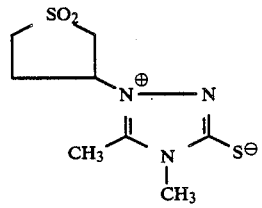

B 13

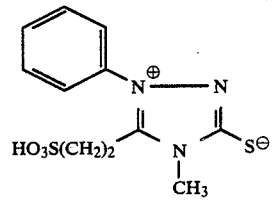

B 14

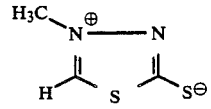

B 15

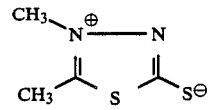

B 16

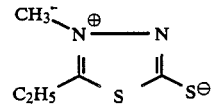

B 17

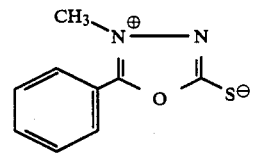

B 18

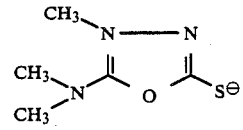

-continued

B 19

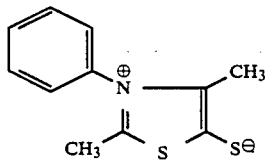

B 20

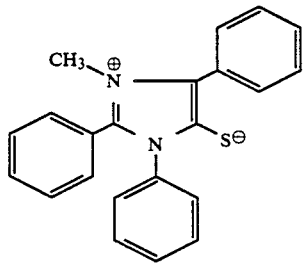

B 21

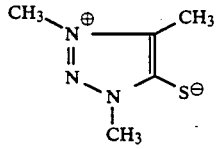

B 22

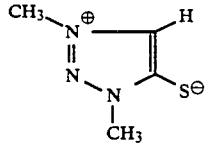

Triazolium thiolates corresponding to formula I are known from U.S. Pat. No. 4,631,253 which also describes the usual production methods. Examples of thiadiazolium thIolates corresponding to formulae 11 and 111 and their preparation can be found in Grashey, Baumann and Lubos, Tetrahedron Letters 1968, 5881 and Kier, Scott, J. Heterocycl. Chem. 5, 277, (1968). The oxadiazolium thiolates corresponding to formulae IV are described by McCarthy, Ollis and Ramsden in J. Chem. Soc., Perkin Trans. I 1974, 627. Thiazolium thiolates corresponding to formula V and imidazolium thiolates corresponding to formula VI are described by Huisgen et al in THL 1967, 1809–14. Examples of triazolium thiolates corresponding to formula VII can be found in Begtrup, Tetrahedron Letters 19, page 1578 (1971).

The quantity in which the compound according to the invention is present in the bleaching and bleaching-/fixing baths varies according to the type of processing solution, the type of photographic material to be processed, the processing temperature, the time required to carry out the desired processing, etc. However, a quantity of $1\times10^{5}$ to 1 mol per liter bleaching or bleaching-/fixing bath is suitable, a quantity of $1\times10^{-3}$ to $1\times10^{-1}$ mol being preferred. In general, the best range is determined by simple preliminary tests. The compound to be used in accordance with the invention may be directly added to the bleaching or bleaching/fixing bath or may be introduced through a preliminary conditioning bath.

The bleaching baths according to the invention may also be used in accelerated processing systems with development times of less than 60 seconds, the color photographic recording materials used therein comprising silver halide emulsion layers of high chloride content (at least 80 mol-% AgCl).

Suitable iron(III) ion complex salts are complexes of iron(III) ions and a chelating agent, such as an aminopolycarboxylic acid, an aminopolyphosphonic acid or a salt thereof, more particularly an alkali metal salt or ammonium salt.

Typical examples of chelating agents are ethylenediaminetetraacetic acid; disodium ethylenediaminetetraacetate; diammonium ethylenediaminetetraacetate; tetra-(trimethyl-ammonium)-ethylenediaminetetraacetate; tetrapotassium ethylenediaminetetraacetate; tetrasodium ethylenediaminetetraacetate; trisodium ethylenediaminetetraacetate; diethylenetriaminepentaacetic acid; pentasodium diethylene-triaminepentaacetate; ethylenediamine-N-β-hydroxyethyl)-N,N',N'-triacetic acid; trisodium ethylenediamine-N-(β-hydroxyethyl)-N,N',N'-triacetate; triammonium ethylenediamine-N-(βhydroxyethyl)-N,N',N'-triacetate; propylenediaminetetraacetic acid; disodium propylenediaminetetraacetate; nitrilotriaceticacid; trisodium nitrilotriacetate; cyclohexanediaminetetraacetic acid; disodium cyclohexanediaminetetraacetate; nitrilotriacetic acid; trisodium nitrilotriacetate; cyclohexanediaminetetraacetic acid; disodium cyclohexanediaminetetraacetate; iminodiacetic acid; dihydroxyethyl glycine; ethylether diaminetetraacetic acid; glycol ether diaminetetraacetic acid; ethylenediaminetetrapropionic acid; phenylenediaminetetraacetic acid; 1,3-diaminopropanol-N,N,N'-N'-tetramethylenephosphonic acid; ethylenediamine-N,N,N',N'-tetramethylenephosphonic acid; 1,3-propylenediamine-N,N,N',N'-tetramethylenephosphonic acid, etc.

The iron(III) ion complex salt may be used in the form of the complex salt or may be prepared in situ in the bleaching or bleaching/fixing bath. Suitable cations are alkali cations and ammonium; ammonium is preferred.

The bleaching solution according to the invention may contain rehalogenating agents, such as bromides (for example potassium bromide, sodium bromide, ammonium bromide, etc.), chlorides (for example potassium chloride, sodium chloride, ammonium chloride, etc.) and the like in addition to the bleaching agents. In addition, additives which have a pH-buffering effect, such as inorganic acids, organic acids or salts thereof, which are normally used in standard bleaching solutions (for example boric acid, borax, sodium metaborate, acetic acid, sodium acetate, sodium carbonate, potassium carbonate, phosphorus acid, phosphoric acid, sodium phosphate, citric acid, sodium citrate, tartaric acid, etc.), may be added.

The pH value of the bleaching solution is preferably from 3.0 to 8.0 and more preferably from 4.0 to 7.0.

Where the compounds according to the invention are used in a bleaching/fixing bath, it is possible to use standard fixing agents, i.e. water-soluble agents dissolving silver halide, such as thiosulfate (for example sodium thiosulfate, ammonium thiosulfate, ammonium sodium thiosulfate, potassium thiosulfate, etc.); thiocyanates (for example sodium thiocyanate; ammonium thiocyanate; potassium thiocyanate, etc.); thioether compounds (for example ethylene-bis-thioglycolic acid, 3,6-dithia-1,8-octanediol, etc.); and thioureas either individually or in a combination of two or more. It is also possible to use special bleaching and fixing agents which contain a combination of a fixing agent and a large quantity of a halide compound, such as potassium iodide.

The iron(III) ion complex salt is normally present in the bleaching/fixing composition in a quantity of 0.1 to 1 mol/l. The fixing agent is present in a quantity of generally 0.2 to 4 mol per liter of the bleaching/fixing solution.

Bleaching/fixing solutions may additionally contain preservating agents, such as sulfites(for example sodium sulfite, potassium sulfite, ammonium sulfite, etc.), hydroxylamine, hydrazine, aldehyde-bisulfite adducts (for example acetaldehyde/sodium bisulfite adduct), etc. It is also possible to use various optical brighteners, foam inhibitors, surfactants, organic solvents (for example methanol) and known bleaching/fixing accelerators, for example polyamine compounds (US-PS 3,578,457), thioureas (U.S. Pat. No. 3,617,283), iodides (DE-PS 1 127 715), polyethylene oxides (DE-PS 966 410), nitrogen-containing heterocyclic compounds (DE-PS 1 290 812) and other thioureas. The in-use pH value of the bleaching/fixing solution is normally from 4.0 to 9.0 and preferably from 5.0 to 8.0.

EXAMPLE

Test 1

A color negative paper comprising a silver chloride bromide emulsion (80% AgBr and 20% AgCl) is exposed behind a step wedge and processed as follows:

| | |
|---|---|
| color developer | 210 secs. 33° C. |
| rinsing | 20 secs. 20° C. |
| stripping of water from the surface of the images | 50 secs. 20° C. |
| bleaching bath | |
| rinsing | 60 secs. 20° C. |
| fixing bath | 60 secs. 20° C. |
| rinsing | 120 secs. 20° C. |
| drying | |

Determination of residual silver

The step wedges reproduced are examined with a Photo-Matic PM 8030 infrared silver detector (Photo-Matic, Denmark). The following Table shows whether any residual silver is still present in the black areas of the image after use of the freshly prepared bleaching bath. The stability of the bleaching bath was tested after standing for 4 and 15 days at 33° C. In addition, the level of sedimentation, which can occur above all in the in-use state of a bleaching bath containing silver ions, was evaluated after standing for 15 days.

Test 2

The procedure is as in test 1, 2.2 g thioglycerol/l being added to the bleaching bath as comparison substance.

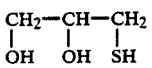

C 1

Test 3

The procedure is as in test 1, 2.3 g/l of the compound C 2 being added to the bleaching bath as comparison substance.

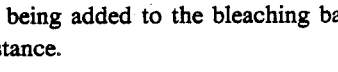

C 2

Test 4

The procedure is as in test 1, 3.7 g/l of the compound C 3 being added to the bleaching bath as comparison substance.

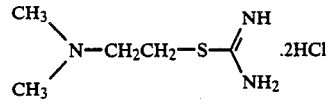

C 3

Test 5

The procedure is as in test 1, 3.0 g/l of the compound C 4 being added to the bleaching bath as comparison substance.

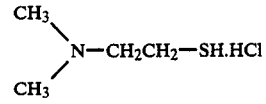

C 4

Test 6

The procedure is as in test 1, 2.9 g/l of the compound B 2 according to the invention being added to the bleaching bath.

Composition of the photographic baths of tests 1–6:

| | | |
|---|---|---|
| Color developer: | Water | 800 ml |
| | Diethylene glycol | 20 ml |
| | Benzyl alcohol | 12 ml |
| | Sodium sulfite, sicc. | 1,5 g |
| | Hydroxylamine sulfate | 3,0 g |
| | Potassium bromide | 0,6 g |
| | Trisodium nitrilotriacetate | 3,0 g |
| | 4-(N-Ethyl-N-2-methanesulfonyl-amino-ethyl)-2-methylphenylene-diamine-sesquisulfatemono-hydrate (≙ CD 3) | 4,5 g |
| | Potassium carbonate | 30,0 g |
| | water to make 1 liter; adjust the pH to 10.2. | |
| Bleaching bath: | Water | 700 ml |
| | $NH_4$—Fe—EDTA | 65 g |
| | EDTA | 10 g |
| | $NH_4Br$ | 100 g |
| | adjust with acetic acid to pH 6.0 | |
| | make up with water to 1 liter. | |
| Fixing bath: | Ammonium thiosulfate | 100 g |
| | Na sulfite, sicc. | 10 g |
| | Na disulfite | 3 g |
| | make up with water to 1 liter. | |

TABLE

| Test | Addition to bleaching bath | Residual silver after use of a freshly prepared bleaching bath | Residual silver after use of a bleaching bath left standing for 4 days at 33° C. | Residual silver after use of a bleaching bath left standing for 15 days at 33° C. | Sedimentation in the bleaching bath after standing for 15 days at 33° C. |
|---|---|---|---|---|---|
| 1 | comparison | yes | yes | yes | no |
| 2 | comparison | no | yes | yes | yes |
| 3 | comparison | yes | yes | yes | yes |
| 4 | comparison | yes | yes | yes | yes |
| 5 | comparison | yes | yes | yes | no |
| 6 | invention | no | no | no | no |

The Table shows that only the compound B 2 according to the invention is stable in the bleaching bath and, in addition, does not cause any sedimentation.

We claim:

1. Bleaching and bleaching/fixing baths containing an iron-(III) ion complex salt as bleaching agent, characterized in that they additionally contain a 5-membered to 7-membered heterocyclic compound which contains at least one N atom and at least one other heteroatom from the group consisting of O, N, S and which is substituted by —$S^{63}$ and, at a quaternary ring nitrogen atom, carries a positive charge arranged in such a way that a tautomeric charge compensation to a neutral thione form is not possible.

2. Bleaching and bleaching/fixing baths as claimed in claim 1, characterized in that the heterocyclic compound corresponds to the following general formula

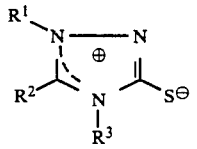

(I)

in which $R^1$ represents $C_1$–$C_8$ alkyl, heteroaryl, $C_5$–$C_{10}$ cycloalkyl and $C_6$–$C_{12}$ aryl, optionally containing a hydrophilicizing group, $R^2$ represents hydrogen, $C_1$–$C_8$ alkyl, $C_2$–$C_8$ alkenyl, heteroaryl, $C_5$–$C_{10}$ cycloalkyl and $C_{16}$–$C_{12}$ aryl, $C_1$–$C_8$ dialkylamino, optionally containing a hydrophilicizing group, $R^3$ represents amino, acylamino, $C_1$–$C_8$ dialkylamino, sulfonamido, sulfamoylamino, $C_1$–$C_8$ alkyl, $C_2$–$C_8$ alkenyl, $C_1$–$C_3$ alkoxy-$C_1$–$C_5$-alkyl, $C_5$–$C_{10}$ cycloalkyl and $C_6$–$C_{12}$ aryl, optionally containing a hydrophilicizing group;

$R^1$ and $R^2$ or $R^2$ and $R^3$ together may represent the groups required to complete a heterocyclic ring.

3. Bleaching and bleaching/fixing baths as claimed in claim 1, characterized in that the heterocyclic compound corresponds to formulae II and/or III below

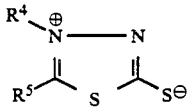

II

-continued

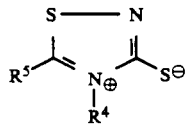

III in which $R^4$ represents $C_1$–$C_8$ alkyl, heteroaryl, $C_5$–$C_{10}$ cycloalkyl and $C_6$–$C_{12}$ aryl, optionally containing a hydrophilicizing group, $R^5$ represents hydrogen, di-$C_1$–$C_8$-alkylamino, $C_1$–$C_8$ alkyl, $C_2$–$C_8$ alkenyl, heteroaryl, $C_5$–$C_{10}$ cycloalkyl and $C_6$–$C_{12}$ aryl, optionally containing a hydrophilicizing group;

$R^4$ and $R^5$ together may represent the groups required to complete a heterocyclic ring.

4. Bleaching and bleaching/fixing baths as claimed in claim 1 characterized in that the heterocyclic compound corresponds to formula IV:

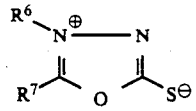

IV in which $R^6$ represents $C_1$–$C_8$ alkyl, heteroaryl, $C_5$—$C_{10}$ cycloalkyl and $C_6$–$C_{12}$ aryl, optionally containing a hydrophilicizing group, $R^7$ represents hydrogen, di-$C_1$–$C_8$-alkylamino, $C_1$–$C_8$ alkyl, $C_2$–$C_8$ alkenyl, $C_5$–$C_6$ heteroaryl, $C_5$–$C_{10}$ cycloalkyl and $C_6$–$C_{12}$ aryl, optionally containing a hydrophilicizing group;

$R^6$ and $R^7$ together may represent the groups required to complete a heterocyclic ring.

5. Bleaching and bleaching/fixing baths as claimed in claim 1, characterized in that the heterocyclic compound corresponds to formula V

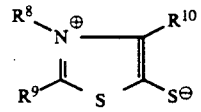

V in which $R^8$ represents $C_1$–$C_8$ alkyl, heteroaryl, $C_5$–$C_{10}$ cycloalkyl and $C_6$–$C_{12}$ aryl, optionally containing a hydrophilicizing group, $R^9$ and $R^{10}$ represent hydrogen, $C_1$–$C_8$ alkyl, $C_2$–$C_8$ alkenyl, heteroaryl, $C_5$–$C_{10}$ cycloalkyl and $C_6$–$C_{12}$ aryl, optionally containing a hydrophilicizing group;

$R^8$ and $R^9$ or $R^8$ and $R^{10}$ together may represent the groups required to complete a heterocyclic ring.

6. Bleaching and bleaching/fixing baths as claimed in claim 1, characterized in that the heterocyclic compound corresponds to formula VI

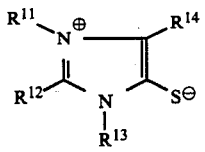

VI in which $R^{11}$ and $R^{13}$ represent $C_1$–$C_8$ alkyl, $C_5$–$C_6$ heteroaryl, $C_5$–$C_{10}$ cycloalkyl and $C_6$–$C_{12}$ aryl, optionally containing a hydrophilicizing group, $R^{12}$ and $R^{14}$ represent hydrogen, $C_1$–$C_8$ alkyl, $C_2$–$C_8$ alkenyl, heteroaryl, $C_5$–$C_{10}$ cycloalkyl and $C_6$–$C_{12}$ aryl, optionally containing a hydrophilicizing group;

$R^{11}$ and $R^{14}$ or $R^{11}$ and $R^{12}$ or $R^{13}$ and $R^{14}$ together may represent the groups required to complete a heterocyclic ring.

7. Bleaching and bleaching/fixing baths as claimed in claim 1, characterized in that the heterocyclic compound corresponds to formula VII

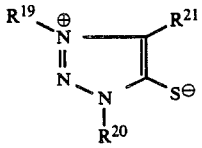

VII in which $R^{19}$ and $R^{20}$ represent $C_1$–$C_3$ alkyl, $R^{21}$ represents hydrogen and methyl.

8. Bleaching and bleaching/fixing baths as claimed in claim 1, the additional compound being used in a quantity of $10^{-5}$ to 1 mol per liter bleaching or bleaching-/fixing bath.

9. Bleaching and bleaching/fixing baths as claimed in claim 1, characterized in that the iron(III) ion complex salt of ethylenediaminetetraacetic acid is used as the bleaching agent.

* * * * *